United States Patent [19]

Goss

[11] Patent Number: 4,981,288

[45] Date of Patent: Jan. 1, 1991

[54] ADJUSTABLE SUPPORT APPARATUS

[76] Inventor: Lionel B. Goss, 104 Riverton Ave., Denton, Md. 21629

[21] Appl. No.: 352,809

[22] Filed: May 16, 1989

[51] Int. Cl.[5] ..... B25Q 1/00

[52] U.S. Cl. ..... 269/79; 269/904

[58] Field of Search ..... 298/454, 455, 456, 451, 298/394, 395, 396, 397, 170, 188.5, 188.91; 108/4, 6–10; 269/904, 71, 79, 76, 69, 289 R

[56] References Cited

U.S. PATENT DOCUMENTS

| | | | |
|---|---|---|---|
| 2,197,278 | 2/1939 | Sverdahl . | |
| 3,047,165 | 7/1962 | Hutchinson | 269/904 |
| 3,524,239 | 3/1968 | Lewis . | |
| 3,940,771 | 2/1976 | Wild | 248/396 |
| 4,070,013 | 1/1978 | Sickler . | |
| 4,237,614 | 12/1980 | Williams . | |
| 4,313,597 | 2/1982 | Hooper | 269/79 |
| 4,715,760 | 12/1987 | Browning | 269/904 |

*Primary Examiner*—Robert C. Watson

*Attorney, Agent, or Firm*—David B. Newman, Jr. & Associates

[57] ABSTRACT

An adjustable support apparatus for supporting a cabinet when installing the cabinet above a counter top, including an adjustable leg, an adjustable arm, and a cabinet-support member. The cabinet-support member extends substantially horizontally for supporting the cabinet during installation. The adjustable leg has one end pivotally connected to the cabinet-support member. The other end of the adjustable leg sets on the back of the counter top. The adjustable leg extends substantially vertically and is adjusted for supporting the cabinet-support member horizontally and at the desired height for installing the cabinet. The adjustable arm includes one end pivotally connected to the cabinet-support member. The other end of the adjustable arm is secured near the edge of the counter top. The adjustable arm extends diagonally and is adjusted for supporting the cabinet-support member horizontally and at the desired height for installing the cabinet.

13 Claims, 9 Drawing Sheets

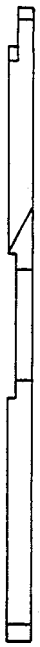
Fig 7A
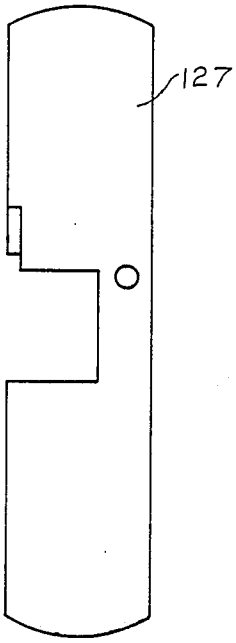
Fig 7B
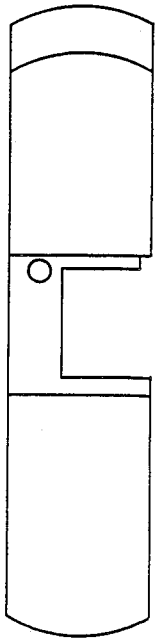
Fig 7C
Fig 8A
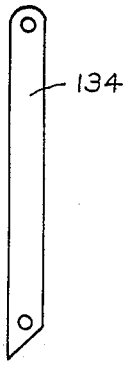
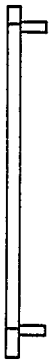
Fig 8B

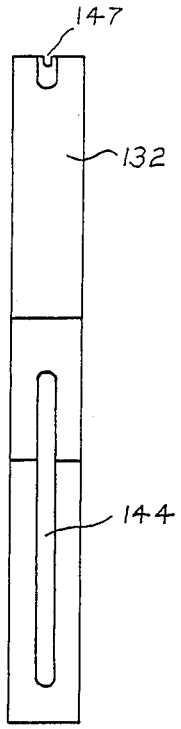
Fig 9A
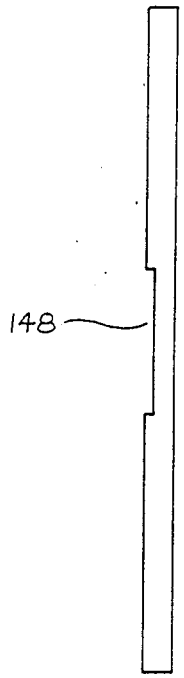
Fig 9B
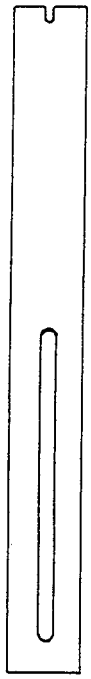
Fig 9C
Fig 9D
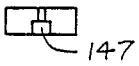

ADJUSTABLE SUPPORT APPARATUS

BACKGROUND OF THE INVENTION

This invention relates to an adjustable support apparatus for supporting a cabinet during installation, and more particularly to an adjustable support apparatus having a slideable leg and arm connected to a cabinet-support member.

DESCRIPTION OF THE PRIOR ART

Prior art devices have included various forms of lumber clamps and braces designed for the purpose of erecting beams, wall panels, ceiling panels and the like. Such devices includes the stud gripping clamp described in U.S. Pat. No. 4,070,013 issued to Sickler on Jan. 24, 1978, a screed as described in U.S. Pat. No. 2,197,287 issued to Sverdahl on Apr. 16, 1940, a wall panel mounter as described in U.S. Pat. No. 3,524,239 issued to Lewis on Aug. 18, 1970, and the adjustable locator for furring strips as described in U.S. Pat. No. 4,237,614 issued to Williams on Dec. 9, 1980. While all of these prior art patented inventions are used in construction, none are directed toward assisting with the installation of cabinets.

Typically an installer of a cabinet requires a second person to hold the cabinet in place while the installer secures the cabinet to a wall. This type of installation procedure might be found when installing a cabinet in a kitchen of a home, wherein the cabinet would be placed above a kitchen counter. Problems with this type of installation of cabinets is that two people are required. Also, the positioning of the cabinet requires a second person to hold the cabinet in place. The second person increases construction labor costs, and installation of a cabinet may be delayed if the second person is not readily available.

OBJECTS AND SUMMARY OF THE INVENTION

An object of the present invention is to provide an adjustable support apparatus for supporting a cabinet when installing the cabinet above a counter top.

Another object of the invention is to provide an adjustable support apparatus for supporting a cabinet that is simple and easy to use.

A further object of the invention is to provide an adjustable support apparatus for supporting a cabinet that can adjust to any desired height for installing a cabinet.

A still further object of the invention is to provide an adjustable support apparatus for supporting a cabinet that is collapsible and easy to carry.

An additional object of the invention is to provide an adjustable support apparatus for supporting a cabinet that is easy to manufacture.

According to the present invention, as embodied and broadly described herein, an adjustable support apparatus for supporting a cabinet when installing the cabinet above a counter top is provided comprising a lower-front arm, an upper-front arm, a cabinet-support member, an upper-back leg, a lower-back leg, and a cabinet stabilizer. A block is clamped to an edge of the counter top. The lower-front arm has a notch at one end for securing the lower-front arm with the block. The upper-front arm is connected to the lower-front arm. The cabinet-support member is connected pivotally to the upper-front arm, and extends substantially horizontally and at the desired height for supporting the cabinet during installation. The upper-back leg is connected pivotally to the cabinet-support member. The lower-back leg is connected to the upper-back leg, and the upper-back leg and the lower-back leg extend substantially vertically and at the desired height for supporting the cabinet-support member. The cabinet stabilizer is connected to the cabinet-support member for stabilizing the cabinet during installation.

Additional objects and advantages of the invention will be set forth in part in the description which follows, and in part will be obvious from the description, or may be learned by practice of the invention.

BRIEF DESCRIPTION OF THE DRAWINGS

The accompanying drawings, which are incorporated in and constitute a part of this specification, illustrate a preferred embodiment of the invention, and together with the description, serve to explain the principles of the invention.

FIG. 7A shows a left side view of a cabinet stabilizer according to the present invention;

FIG. 7B shows a top view of a cabinet stabilizer according to the present invention;

FIG. 7C shows a bottom view of a cabinet stabilizer according to the present invention;

FIG. 8A shows a front view of a corner brace;

FIG. 8B shows a side view of a corner brace;

FIG. 9A shows a front view of a base-horizontal-support member;

FIG. 9B shows a side view of a base-horizontal-support member;

FIG. 9C shows a back view of a base-horizontal-support member;

FIG. 9D shows an end view of a base-horizontal-support member; and

DETAILED DESCRIPTION OF THE PREFERRED EMBODIMENTS

Reference will now be made to the present preferred embodiments of the invention, examples of which are illustrated in the accompanying drawings.

Figure 1:
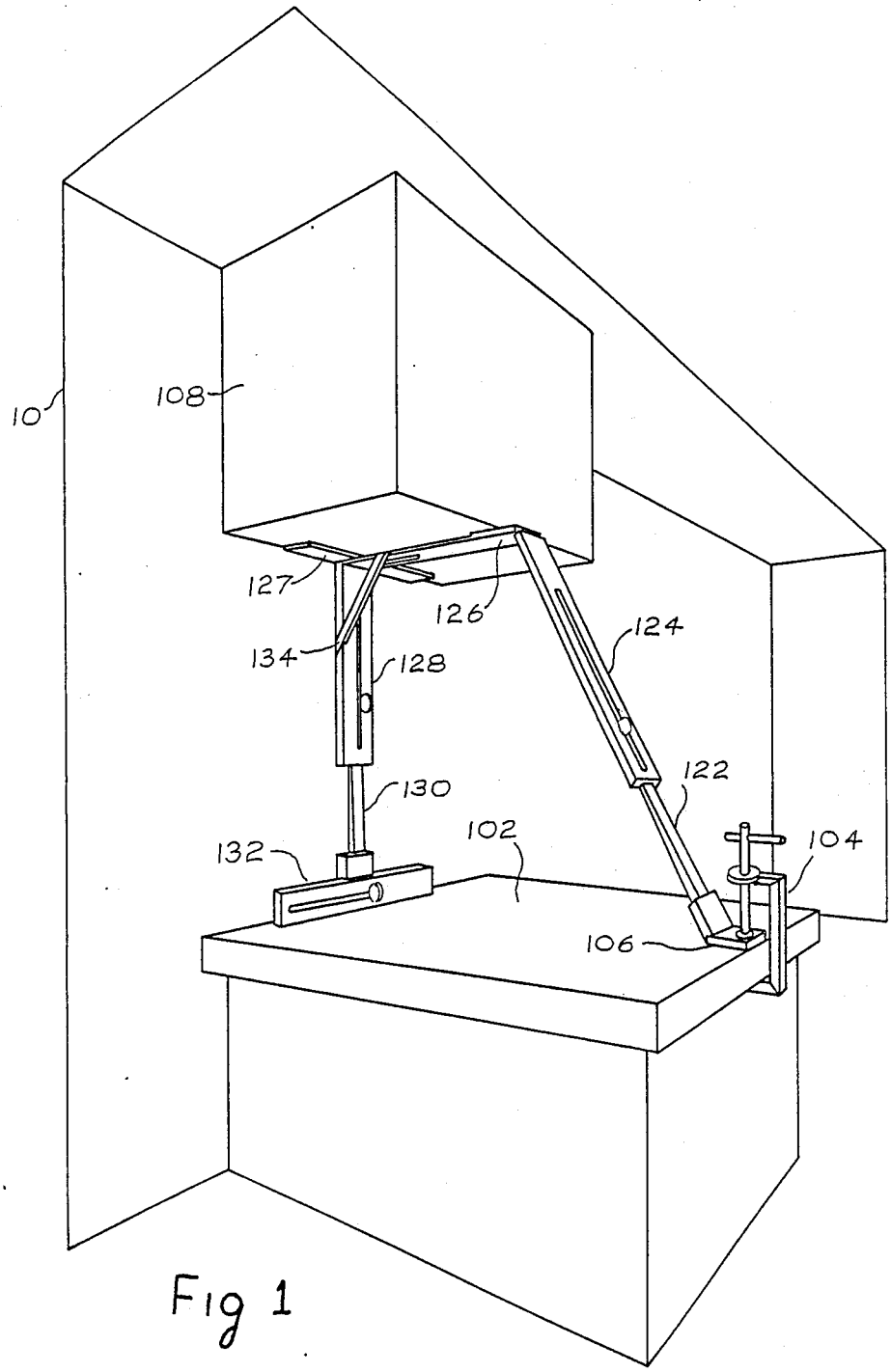
FIG. 1 shows an adjustable support apparatus holding a cabinet in place above a counter top.

FIG. 1 illustratively shows an adjustable support apparatus for supporting a cabinet when installing the cabinet above a counter top comprising cabinet-support means, leg means, and arm means. The cabinet-support means may be embodied as a cabinet-support member 126, the leg means may be embodied as an adjustable leg having an upper-back leg 128 and a lower-back leg 130. The arm means may be embodied as an adjustable arm having an upper-front arm 124 and a lower-front arm 122. As illustratively shown in FIG. 1, the lower-front arm 122 includes a notch at one end for securing the lower-front arm 122 with a block 106 which is clamped with a clamp 104 to a counter top 102. The upper-front arm 124 is connected to the lower-front arm 122. The upper-front arm 124 and lower-front arm 122 are adjusted by sliding them to the proper length, to support the cabinet-support member 126 substantially horizontally. The cabinet-support member 126 is connected to the upper-front arm 124, and extends substantially horizontally and at the desired height for installing the cabinet 108 during installation. The upper-back leg 128 is connected to the cabinet-support member 126. The lower-back leg 130 is connected to the upper-back leg 128. The upper-back leg 128 and the lower-back leg 130 extend substantially vertically and are extended to the desired height for supporting the cabinet-support member 126. The cabinet stabilizer 127 can be connected to the cabinet-support member 126 for stabilizing the cabinet during installation. In practice, the adjustable support apparatus may have the upper support arm 124 pivotally connected to the cabinet-support member 126, and the upper-back leg 128 pivotally connected to the cabinet-support member 126. Also shown is a wall 10 against which the cabinet 108 is to be mounted.

Figure 2A:
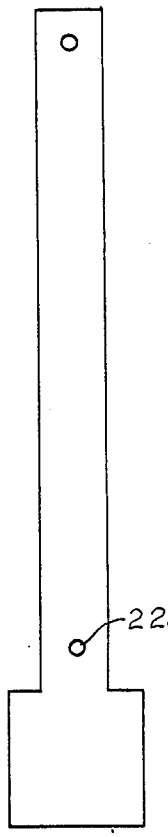
FIG. 2A shows a back view of a lower-front arm according to the present invention.
Figure 2B:
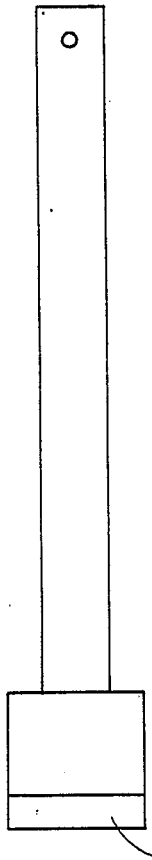
FIG. 2B shows a front view of a lower-front arm according to the present invention.
Figure 2C:
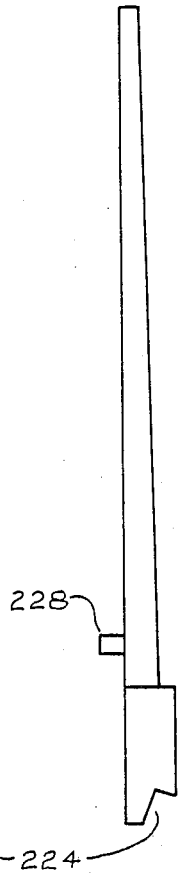
FIG. 2C shows a side view of a lower-front arm according to the present invention.
Figure 2D:
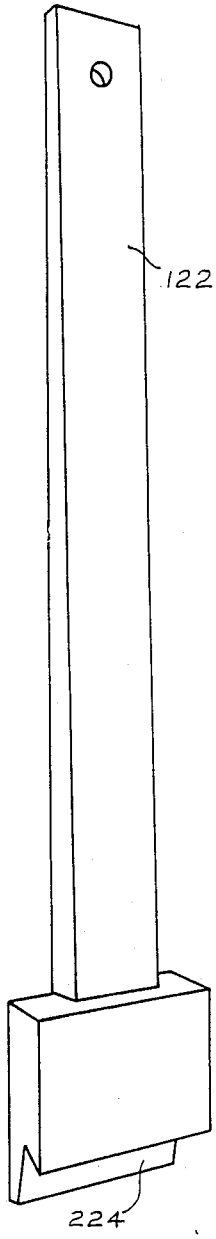
FIG. 2D shows an oblique view of a lower-front arm according to the present invention.
Figure 3A:
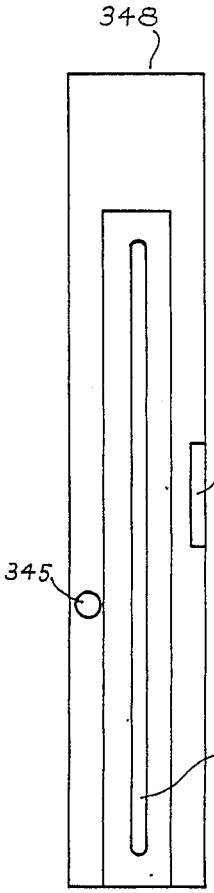
FIG. 3A shows a front view of an upper-front arm according to the present invention.
Figure 3B:
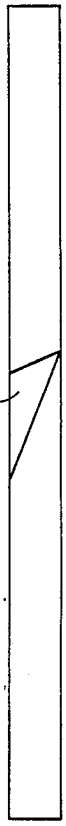
FIG. 3B shows a right side view of an upper-front arm according to the present invention.
Figure 3D:
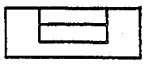
FIG. 3D shows a bottom view of an upper-front arm according to the present invention.
Figure 3C:
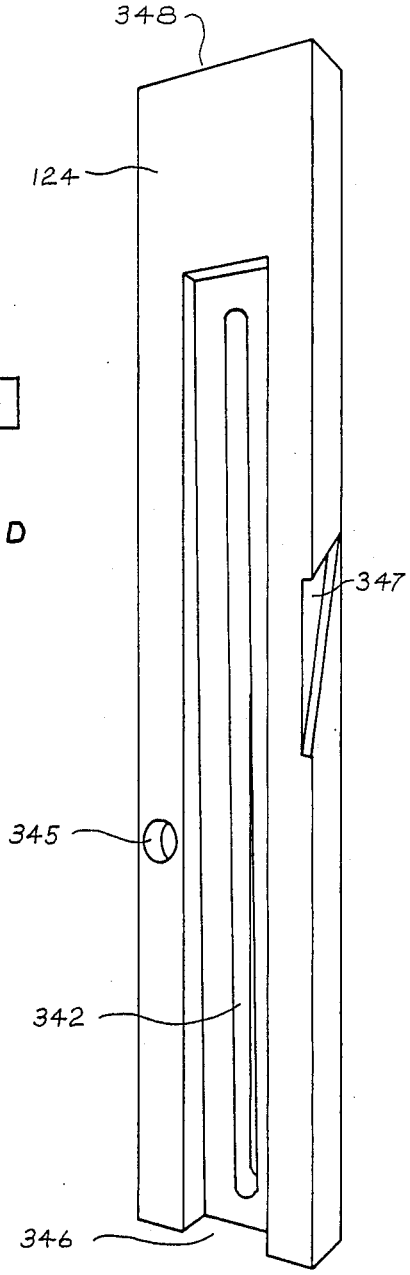
FIG. 3C shows an oblique view of an upper-front arm according to the present invention.

FIGS. 2A, 2B, 2C, and 2D illustrate a design of the lower-front arm 122 for a particular embodiment of the invention. FIGS. 2A, 2B, 2C, and 2C show the back view, a front view, a side view, and an oblique view, respectively, of the lower-front arm 122. A notch 224 is shown at one end of the lower-front arm 122. Also, as shown in the side view and partially shown in the oblique view, the lower-front arm includes a taper, with a dowel member 228 projecting therefrom. The notch 224 is where the lower-front arm 122 secures against the block 106, which is clamped with clamp 104 to the counter top 102.

FIGS. 3A, 3B, 3C, and 3D depict the upper-front arm 124 showing a front view, a right side view, an oblique view, and a bottom view, respectively. As indicated, the upper-front arm may include a slot 342, a notch 343, and a hole 345. Also shown from the oblique view, is the tapered slot 346 wherein the lower-front arm inserts. The lower-front arm adjustably slides in the slot 346. A notch 347 is shown on the oblique view. A hinge 348 is attached at one end of the upper-front arm 124 for pivotally connecting the upper-front arm 124 to the cabinet-support member 126 of FIG. 1.

Figure 4A:
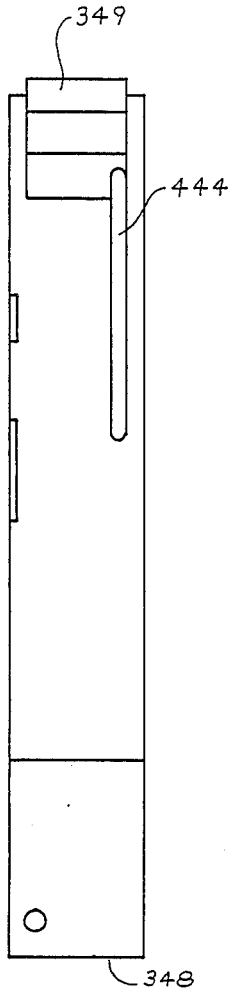
FIG. 4A shows a front view of a cabinet-support member according to the present invention.
Figure 4B:
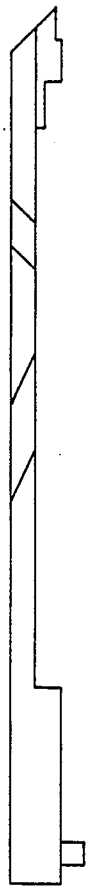
FIG. 4B shows a left side view of a cabinet-support member according to the present invention.
Figure 4C:
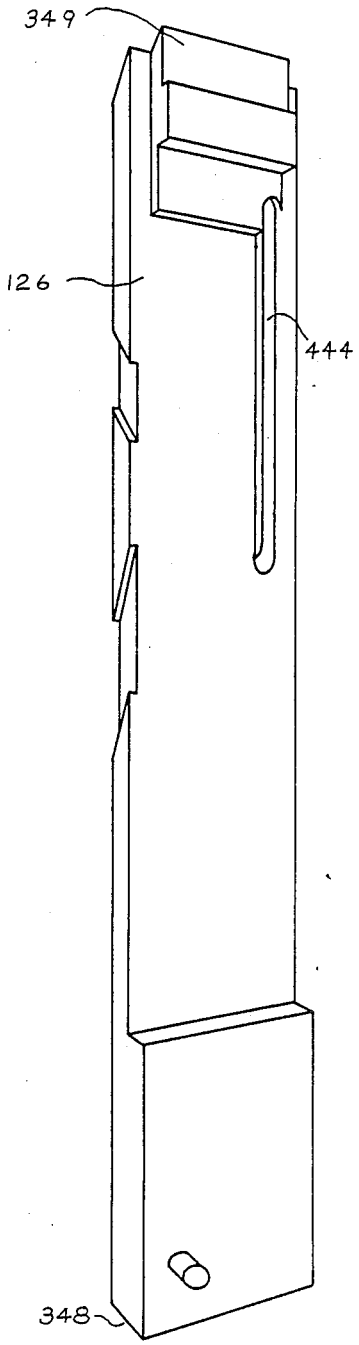
FIG. 4C shows an oblique view of a cabinet-support member according to the present invention.

The cabinet-support member 126 of FIG. 1 is shown for a particular embodiment of the present invention in FIGS. 4A, 4B, and 4C. FIGS. 4A, 4B, and 4C show a front view view, a left side view, and an oblique view, respectively. The hinge 348 is shown attached at one end of the cabinet-support member 126 for connecting the cabinet-support member 126 pivotally to the upper-front arm 124. A second hinge 349 also is shown attached to the other end of the cabinet-support member 126 for pivotally connecting the cabinet-support member 126 to the upper-back leg 128 as shown in FIG. 1. FIG. 4C illustrates several notches on the side of the cabinet-support member 126 which receive a corner brace 134 of FIGS. 8A and 8B, when the adjustable support apparatus is in the folded position.

Figure 5A:
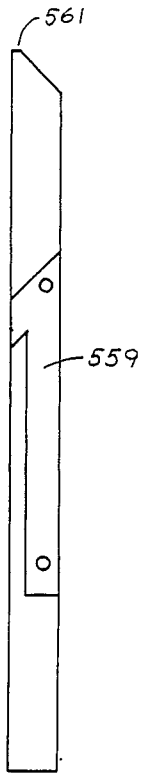
FIG. 5A shows a left side view of an upper-back leg according to the present invention.
Figure 5B:
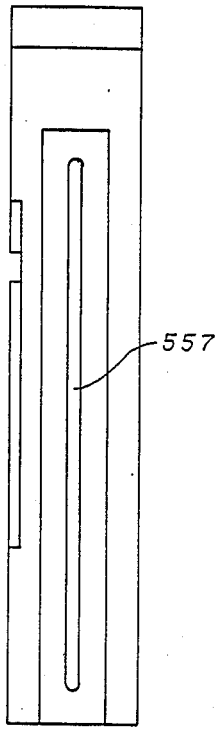
FIG. 5B shows a front view of an upper-back leg according to the present invention.
Figure 5C:
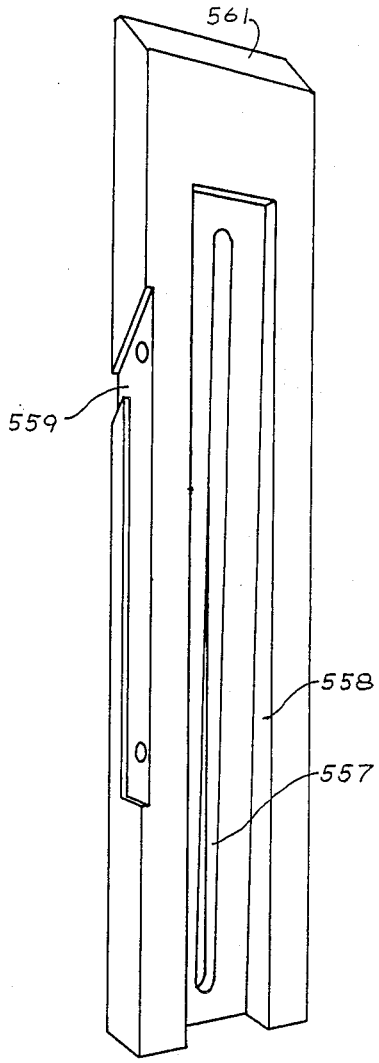
FIG. 5C shows an oblique view of an upper-back leg according to the present invention.
Figure 6A:
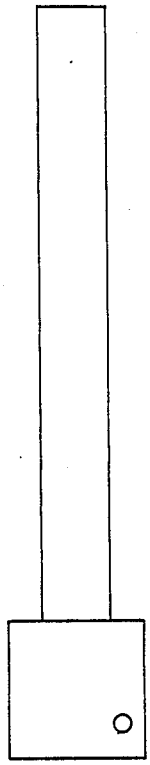
FIG. 6A shows a back view of a lower-back leg according to the present invention.
Figure 6B:
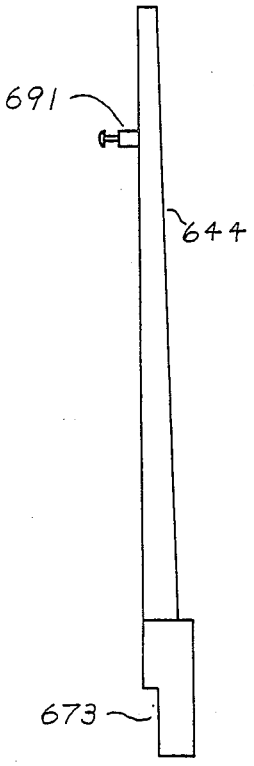
FIG. 6B shows a right side view of a lower-back leg according to the present invention.
Figure 6C:
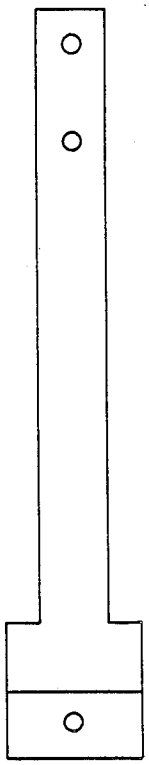
FIG. 6C shows a front view of a lower-back leg according to the present invention.
Figure 6D:
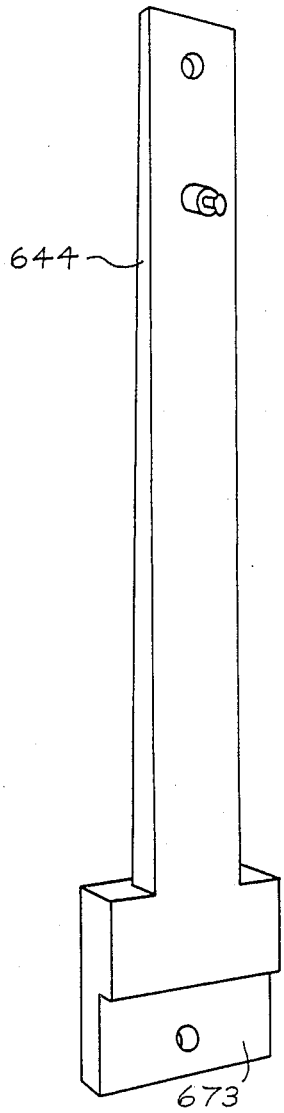
FIG. 6D shows an oblique view of a lower-back leg according to the present invention.

FIGS. 5A, 5B, and 5C illustratively show the upper-back leg 128 of FIG. 1, having a left side view, a front view, and an oblique view, respectively. The hinge 349 of FIG. 4B is attached to one end 561 of the cabinet-support member 126. Also shown is a notch 559 for storing the corner brace, as used in one particular embodiment of the invention. The upper-back leg has a tapered area 558, with a slot 557 included therein.

FIGS. 6A, 6B, 6C, and 6D depicts the lower-back leg 130 of FIG. 1 having a bottom view, a right side view, a front view, and an oblique view, respectively. The lower-back leg 130 may include a dowel 645 which slides inside the slot of the upper-back leg 128, of the slot 557. The lower-back leg 130 may be tapered 644 for sliding within the tapered area 558 of the upper-back leg 128 as shown in FIG. 5C. The lower-back leg 130 also may include a support notch 673.

FIGS. 7A, 7B, and 7C illustrate the cabinet stabilizer 700 having, respectively, a left side view, a top view, and a bottom view. FIGS. 8A and 8B show a corner brace 134 with a front view and a side view, respectively. The corner brace 134 also may be used as a containment brace when the adjustable support apparatus is in the folded position. In this use, the corner brace 134 fits into the notch in FIG. 4C of the cabinet support member when the adjustable support apparatus is in the folded position, and serves to hold the folded parts of the adjustable support apparatus together.

FIGS. 9A, 9B, 9C, and 9D show the front view, side view, back view and end view of base-horizontal-support member 132, respectively. The base-horizontal-support member 132 includes a screw-hole 145, slide slot 144, a slide notch 148 and end notch 147.

Figure 10:
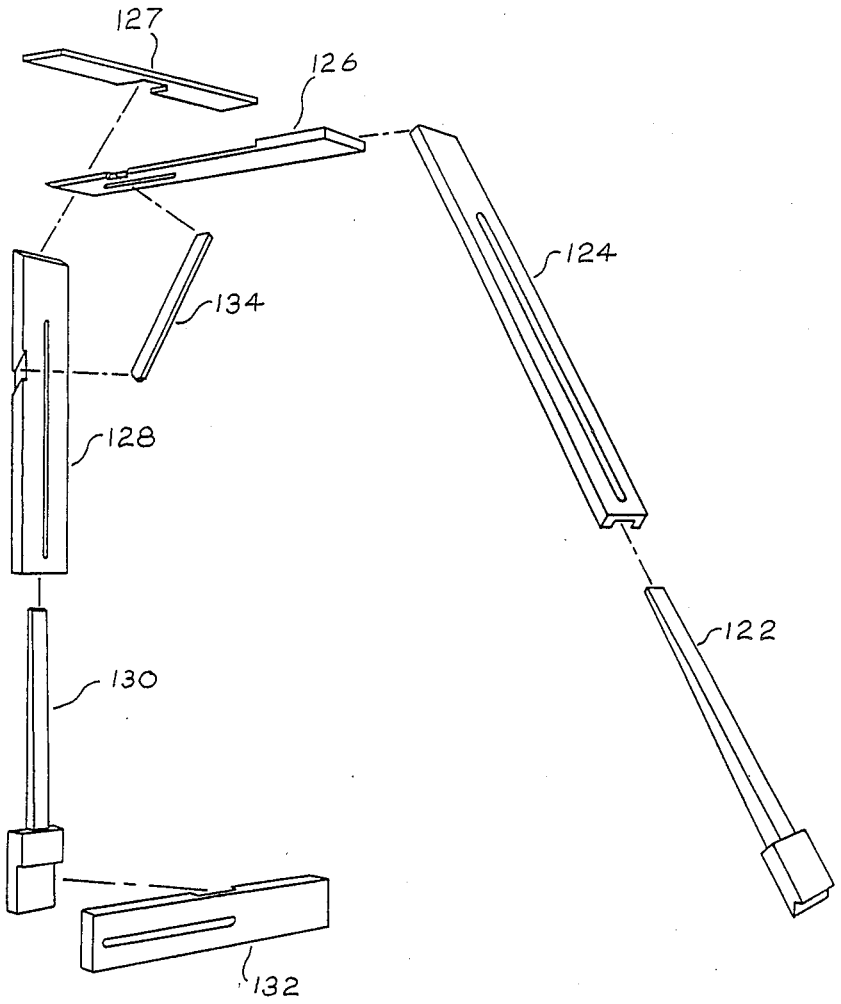
FIG. 10 illustrates assembly of the adjustable support apparatus according to the present invention.

As shown in FIG. 10, the lower-back leg 129 connects to the upper-back leg 128. An additional base-horizontal-support member 132 may be connected to the lower-back leg 129. The base-horizontal-support member 132 slideably attaches to the lower-back leg 129 using slide slot 144. In use, the base-horizontal-support member 132 slides down the front side of lower-back leg 129, and pivots 45° and slides horizontally until the slide notch 148 and the support notch 673 of lower-back leg 129 are in line. These notches are then interlocked and secured with thumb screws, to provide a secure horizontal base support. The end notch 147 of base-horizontal-support member 132 holds the base-horizontal-support member 132 in place when the base-horizontal-support member 132 and lower-back leg 129 are in the folded position. Base-horizontal-support member 132 slides up lower-back leg 129 and over the dowel and nail 691 as shown on FIG. 6B. By tightening the thumb screw at the bottom where base-horizontal-support member 132 pivots, the base-horizontal-support member 132 is then secured in its folded position.

The upper-back leg 128 pivotally connects to the cabinet-support member 126, and corner brace 134 snaps between cabinet-support member 126 and the upper-back leg 128 for stabilizing the adjustable support apparatus. A cabinet stabilizer 127 may insert onto cabinet-support member 126. The cabinet-support member 126, as shoWn in FIG. 10, pivotally connects to the upper-front arm 124, and the upper-front arm 124 connects to the lower-front arm 122. The lower-front arm 122 includes a dowel fitting into the slot of the upper-front arm 124.

In the exemplary arrangement shown in FIG. 1, when erected, the basic elements of the present invention include having the lower-front arm 122 connected and secured to the upper-front arm 124 in a fixed position, and the lower-back leg 130 connected and secured to the upper-back leg 128 in a fixed position. The lower-front arm 122 and the upper-front arm 124, and the lower-back leg 130 and the upper back leg 128, are adjusted to the proper height for the cabinet-support member 126 to support a cabinet 108 against a wall 10. As indicated, a clamp 104 can hold a block 106 in place for allowing the notch at one end of the lower-front leg 122 to secure thereon. After the cabinet 108 is set in place on the cabinet-support member 126, the cabinet 108 can be secured to the wall 10. The cabinet-support apparatus can be disengaged and disassembled underneath the cabinet 108, after fastening the cabinet 108 to the wall 10.

For the particular embodiment shown, when the adjustable support apparatus is not in use, it can be folded and collapsed in to a compact position for easy carrying in a tool chest or other support case.

It will be apparent to those skilled in the art that various modifications can be made to the adjustable support apparatus of the instant invention without departing from the spirit or scope of the invention, and it is intended that the present invention cover modifications and variations of the adjustable support apparatus provided they come within the scope of the appended claims and their equivalents.

I claim:

1. An adjustable support apparatus for supporting a cabinet when installing the cabinet above a counter top, said counter top having a block clamped to an edge of said counter top, said adjustable support apparatus comprising:

a lower-front arm having a notch at one end for securing with said block;

an upper-front arm connected to said lower-front arm;

a cabinet-support member pivotally connected to said upper-front arm, said cabinet-support member extending substantially horizontally and at the desired height for supporting said cabinet during installation;

an upper-back leg pivotally connected to said cabinet-support member;

a lower-back leg connected to said upper-back leg, wherein said upper-back leg and said lower-back leg extend substantially vertically and at the desired height for supporting said cabinet-support member; and a cabinet stabilizer connected to said cabinet-support member for stabilizing said cabinet during installation.

2. An adjustable support apparatus for supporting a cabinet when installing the cabinet above a counter top, said counter top having an edge, said adjustable support apparatus comprising:

a cabinet-support member extending substantially horizontally for supporting said cabinet during installation;

an adjustable leg having one end connected to said cabinet-support member, and the other end for setting on the back of said counter top, said adjustable leg extending substantially vertically and adjusted for supporting said cabinet-support member horizontally and at the desired height for installing said cabinet; and an adjustable arm having one end connected to said cabinet-support member, said adjustable arm extending diagonally and adjusted for supporting said cabinet-support member horizontally, and means connected to the other end of said arm means for securing said arm means to said counter top.

3. The adjustable support apparatus as set forth in claim 2, wherein said adjustable leg includes an upper-back leg and a lower-back leg connected to said upper-back leg.

4. The adjustable support apparatus as set forth in claim 2, wherein said adjustable arm includes an upper-front arm and a lower-front arm connected to said upper-front arm.

5. The adjustable support apparatus as set forth in claim 2, further including stabilizer means connected to said adjustable leg for stabilizing said adjustable support apparatus.

6. The adjustable support apparatus as set forth in claim 3, further including stabilizer means connected to said cabinet-support member for stabilizing said cabinet during installation.

7. An adjustable support apparatus for supporting a cabinet when installing the cabinet above a counter top, comprising:

a cabinet-support means extending substantially horizontally for supporting said cabinet during installation;

leg means having one end connected to said cabinet-support member, and the other end for setting on the back of said counter top, said leg means extending substantially vertically for supporting said cabinet-support member horizontally for installing said cabinet;

arm means having one end connected to said cabinet-support member, said arm means extending diagonally for supporting said cabinet-support member horizontally, and means connected to the other end of said arm means for securing said arm means to said counter top.

8. The adjustable support apparatus as set forth in claim 7, wherein said leg means includes an upper-back leg and a lower-back leg connected to said upper-back leg.

9. The adjustable support apparatus as set forth in claim 7, wherein said arm means includes an upper-front arm and a lower-front arm connected to said upper-front arm.

10. The adjustable support apparatus as set forth in claim 7, further including stabilizer means connected to said leg means for stabilizing said adjustable support apparatus.

11. The adjustable support apparatus as set forth in claim 8, further including stabilizer means connected to said cabinet-support member for stabilizing said cabinet.

12. The adjustable support apparatus as set forth in claim 7 wherein said leg means and said arm means are pivotally connected to said cabinet-support means, respectively.

13. The adjustable support apparatus as set forth in claim 2 wherein said adjustable leg and said adjustable arm are pivotally connected to said cabinet-support means, respectively.

* * * * *